US009243187B2

(12) United States Patent
Depine de Castro et al.

(10) Patent No.: US 9,243,187 B2
(45) Date of Patent: Jan. 26, 2016

(54) PROCESS FOR THE PRODUCTION OF PITCH

(75) Inventors: Luiz Depine de Castro, Rio de Janeiro (BR); Carlos Henrique Monteiro de Castro Dutra, Rio de Janeiro (BR); Wladimir Ferraz de Souza, Rio de Janeiro (BR)

(73) Assignee: PETROLEO BRASILEIRO S.A.—PETROBRAS, Rio de Janeiro (BR)

( * ) Notice: Subject to any disclaimer, the term of this patent is extended or adjusted under 35 U.S.C. 154(b) by 284 days.

(21) Appl. No.: 14/110,045

(22) PCT Filed: May 27, 2011

(86) PCT No.: PCT/BR2011/000157
§ 371 (c)(1),
(2), (4) Date: Oct. 4, 2013

(87) PCT Pub. No.: WO2012/162766
PCT Pub. Date: Dec. 6, 2012

(65) Prior Publication Data

US 2014/0021093 A1 Jan. 23, 2014

(51) Int. Cl.

| | |
|---|---|
| ***C10C 3/06*** | (2006.01) |
| ***C10C 1/16*** | (2006.01) |
| ***C10G 31/06*** | (2006.01) |
| ***C10G 7/00*** | (2006.01) |

(52) U.S. Cl.
CPC ... *C10C 3/06* (2013.01); *C10C 1/16* (2013.01); *C10G 7/00* (2013.01); *C10G 31/06* (2013.01)

(58) Field of Classification Search
CPC ..... C10C 1/16; C10C 3/00; C10C 3/002; C10C 3/06; C10G 31/06; C10G 7/00
See application file for complete search history.

(56) References Cited

U.S. PATENT DOCUMENTS

| | | | | |
|---|---|---|---|---|
| 4,209,500 | A | 6/1980 | Chwastiak | |
| 4,283,269 | A | 8/1981 | Greenwood | |
| 4,705,618 | A | 11/1987 | Tsuchitani et al. | |
| 4,931,162 | A | 6/1990 | Romine | |
| 5,387,333 | A * | 2/1995 | Tamaki | C10C 3/002 208/3 |
| 2002/0185411 | A1 * | 12/2002 | Saver | B29C 47/0004 208/39 |

FOREIGN PATENT DOCUMENTS

WO 2010/038026 A2 4/2010

* cited by examiner

*Primary Examiner* — Michelle Stein
*Assistant Examiner* — Brandi M Doyle
(74) *Attorney, Agent, or Firm* — Sughrue Mion, PLLC

(57) ABSTRACT

Pitch is obtained, in a reactor configured for the atmospheric process, from a feedstock of oil hydrocarbons consisting of a feedstock of decanted oil. In the process, the feedstock is subjected to heating stages in reflux and distillation conditions with removal of volatile products generated, wherein the gaseous products are eliminated at each stage and the successively generated residual products comprise a final residue recovered as a predominantly isotropic pitch.

10 Claims, 2 Drawing Sheets

PROCESS FOR THE PRODUCTION OF PITCH

FIELD OF THE INVENTION

Pitches are applicable in the manufacture of various carbon materials, which can be produced in the oil industry from a feedstock of decanted oil.

THE BASIS OF THE INVENTION

Pitches are generally carbon-rich products and are raw materials widely used for producing a variety of carbon materials such as carbon anodes for fusing aluminum, graphite electrodes for the steel industry, carbon fibers, poly-granulate graphites or carbon-carbon composites.

In the beginning, distillation processes for producing pitch used the coal tar generated in coking ovens for coal-based steel plants as feedstock. However, environmental problems stimulated the development of products based on raw materials derived from the processing of oil.

Since then, pitches have been produced by distilling decanted oil, also known as aromatic residue, which exhibits a high aromatic content with a BMCI above 120 (BMCI—Bureau of Mines Correlation Index).

Decanted oil is a residue derived from fluid catalytic cracking units in oil refining, usually being reprocessed in refining units for producing coke or used as fuel oil diluent. Therefore, it constitutes an application of greater economic value for obtaining pitch from the distillation of decanted oil.

In distilling a decanted oil, at temperatures up to 470° C., one notes competing reaction mechanisms of the batch components, including: thermal cracking, reticulation, polymerization, poly-condensation and oxidation. These reactions cause the average molecular mass of the components produced from the pitch to increase, consequently contributing to the distinctive physicochemical properties of the product.

For example, the anisotropy of pitches derives from reactions that cause an increase in molecular mass of the hydrocarbons comprising the batch, such as poly-condensation reactions of smaller molecules into planar and larger aromatic molecules. Thus, anisotropy is a characteristic of the raw material that is, for example, useful for spinning carbon fibers with high mechanical strength, since the anisotropy results in large, highly-oriented domains that contribute to the properties of the manufactured material.

Therefore, the properties of carbon materials manufactured from pitches depend on the characteristics of the raw material used.

The hydrocarbons comprising a decanted oil can react in a controlled way, in specific process conditions, and produce pitches with distinct characteristics of: softening point—SP, toluene insolubles—TI and quinolone insolubles—QI. These properties are usually determined in a laboratory by standardized ASTM D-3104, D-4312 and D-2318 tests, respectively, or by equivalent international standards.

In conventional processes in a single distillation stage, pitches are usually produced with a softening point between 80° C. and 120° C., toluene insolubles between 10% and 20% by weight, and quinoline insolubles between 1% and 3% by weight. However, alternatives to decanted oil distillation processes have appeared in specialized literature and patent documents that not only improve the yield but also produce pitches exhibiting distinct properties desirable for manufacturing various carbon materials.

For example, U.S. Pat. No. 4,705,618 describes a process in which a decanted oil containing less than 5% by weight of quinoline insolubles is heated in a tubular heater under defined pressure, temperature, and time conditions. The heater effluent is transferred to a distillation column to separate: light products and intermediate pitches, which yields binder pitches useful for preparing carbon fibers.

U.S. Pat. No. 4,931,162 also describes a process for obtaining pitches useful for producing carbon fibers from the distillation of an aromatic distillate current with an initial boiling point of 390° C. and mesophase-free. The distillation at atmospheric pressure generates a residue containing at least 5% mesophase, which is subjected to a heat treatment in the temperature range between 370° C. and 420° C. and in the presence of inert gas, for converting the resins and obtaining a mesophase pitch.

Patent application WO2010038026 describes a process for distilling decanted oil to increase the yield of binder pitches with improved properties. The process includes a heat treatment stage with reflux of the volatile products generated and subsequent distillation in a single stage for recovery of an oil residue. However, this process does not enable the production of predominantly isotropic pitches with binder pitches properties, that is: toluene insolubles in the range between 30% and 40% by weight quinoline insolubles in the range of 3% to 25% by weight, and a softening point between 100° C. and 120° C., as shown by the process described and claimed below.

SUMMARY OF THE INVENTION

Predominantly isotropic pitches, that is, with a mesophase content of less than 50%, can be produced by reactions of oil hydrocarbon comprising a feedstock of preheated, decanted oil, which is subjected to alternating stages of heating in reflux and distillation conditions with removal of volatile products generated in the reactions, until the obtaining residues comprising the end product of the process.

Simultaneously, thermal cracking, reticulation, polymerization, poly-condensation and hydrocarbon oxidation reactions may occur. These reactions cause the average molecular mass of the components produced from the pitches to increase, consequently contributing to the distinctive physicochemical properties of the end product of the below-described process.

Implementing the process in its stages entails the use of a specially configured reactor and vessels for recovering the generated products, the reactor comprising a reaction vessel to which are coupled: an external heating system, a cooling and product condensation system, a direct internal heating system, and a mechanical system for stirring and homogenizing the feedstock mass and residual products generated within the vessel.

Briefly, the below-described process uses a reactor configured to allow selective control of the reactions of the components of the decanted oil feedstock. And in addition to maximizing the yield in the production of pitches, the process facilitates the production, particularly of binder pitches exhibiting distinct physicochemical properties, such as: softening point between 100° C. and 120° C., toluene insolubles of approximately 30% by weight and quinoline insolubles of approximately 10% by weight.

DETAILED DESCRIPTION OF THE INVENTION

Figure 1:
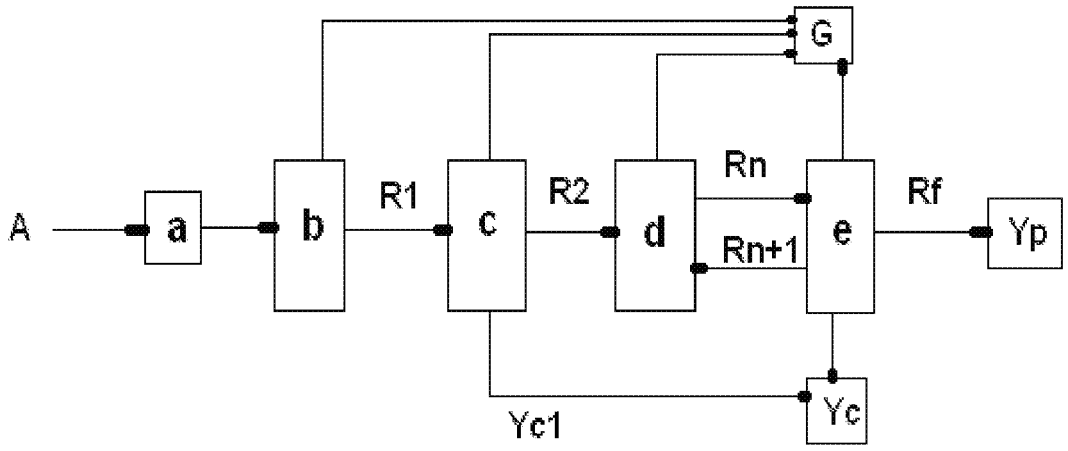
FIG. 1 shows a macro-flow of the process with its stages: (a) preheating of the feedstock; (b) heating in conditions of a first reflux, generating: gaseous products (G) and residual products (R1); (c) distillation of the residual products (R1), generating condensed volatile products (Yc), gaseous products (G) and residual products (R2); (d) heating of the residual products (R2) in reflux conditions, generating: gaseous products (G) and residual products (Rn); (e) distillation of residual products (Rn) generating: gaseous products (G) condensed volatile products (Yc) and residual products (Rn+1), returning to stage (d) until recovering residual products (Rf) comprising pitch (Yp).

The below-described process enables the production of a predominantly isotropic pitch with distinct properties for various industrial applications, including the manufacture of anodes in the aluminum industry and graphite electrodes for the steel industry.

The pitch obtained, particularly binder pitches, exhibit as distinct physicochemical properties: softening point between 100° C. and 120° C., toluene insolubles of approximately 30% by weight, and quinoline insolubles of approximately 10% by weight.

The process involves reactions of the oil hydrocarbons comprising a feedstock of decanted oil, preferably containing between 30% and 80% by weight of aromatics, and is implemented in a reactor configured to enable the selective control of the reactions of the feedstock components, at atmospheric pressure, according to its stages:

a) preheating of the feedstock up to the initial reaction temperature;
b) continuous and uniform heating, in conditions of a first reflux at an initial reaction temperature of between 300° C. and 370° C., for a time sufficient to promote the reactions between the hydrocarbons of the feedstock, in a homogeneous liquid phase, generating: gaseous products that are eliminated and residual products;
c) distillation of the residual products generated in stage b) up to a maximum temperature between 380° C. and 450° C., generating: residual products, gaseous products that are eliminated, and volatile products that are removed by condensation in the proportion between 5% and 60% by weight in relation to the feedstock;
d) continuous and uniform heating of the residual products generated in the preceding distillation stage in reflux conditions at a temperature between 5° C. and 50° C. below the maximum temperature of the distillation, for a time between 1 and 60 times less than that of the heating in stage b), to promote reactions, generating: gaseous products that are removed and residual products in the reaction conditions;
e) distillation of the residual products generated in stage d) up to a maximum temperature between 390° C. and 485° C., generating: gaseous products that are eliminated, volatile products that are removed by condensation, and residual products;
f) sequential repetition of the two preceding stages, d) and e), to obtain residual products comprising pitch with a yield in relation to the feedstock between 30% and 60% by weight; and
g) recovery of the pitch under refrigeration to specify a predominantly isotropic end product.

The decanted oil feedstock coming from a fluid catalytic cracking process comprises hydrocarbons having a boiling point greater than 343° C.; thus the preheating of the feedstock is to homogenize and take the feedstock to the reaction conditions between 300° C. and 370° C.

For heating in a first reflux condition, depending on the components of the feedstock, a time between 1 and 120 hours, preferably between 1 and 90 hours, more preferably between 1 and 60 hours, must be observed. In reflux, the volatile products act as a solvent phase for the residual products generated, and, consequently, inhibit the poly-condensation reactions of larger molecular mass molecules and facilitate the cracking reactions, initially minimizing the generation of quinoline insolubles. Hence, in the distillation stage, the product mass removed must be between 5% and 60% in weight in relation to the feedstock, and preferably between 5% and 40% by weight.

In the following stages of heating, in reflux conditions, at temperatures above 400° C., the paraffin molecules decompose almost completely and alkyl-aromatic dealkylation reactions and condensation reactions of aromatics compounds in the lightest fractions take place.

Therefore, after the first distillation at a maximum temperature between 380° C. and 450° C., in the subsequent stages of heating under reflux conditions at a temperature between 5° C. and 50° C. below the maximum distillation temperature, condensation reactions selectively occur that increase the concentration of insolubles, both in toluene and in quinoline, without a sharp increase in the softening point of the produced pitches.

At the start of each heating stage in reflux conditions, following distillation stages, the lowering of the temperature must be controlled so as to soften the process conditions, thus preventing reactions leading to an increased softening point of the produced pitches. For this reason, the temperature lowering must preferably be controlled within a range between 5° C. and 30° C., by the temperature in the cooling of the products. Similarly, the temperature of each heating in reflux stage must be set in the range between 1 and 60 times less than the first initial reflux stage and, preferably, between 1 and 20 times less.

The repetition of the two stages, that is, of heating in reflux conditions and distillation, will adjust the physical-chemical properties of the recovered pitches at the end of the process; this repetition can be done between 1 and 10 times and, preferably, between 1 and 5 times, until obtaining residual products constituting the specified end product.

At the end of the process, the residue (pitch) is removed and immediately refrigerated, so as to interrupt the reactions that still may generate undesirable characteristics, other than those defined for the end product obtained.

To implement the process, a reactor configured for this purpose must be used, which has: a reaction vessel, a heating system outside the reaction vessel, a heating system inside the reaction vessel for directly heating of the batch and products generated in the reactions of the process, and an internal mechanical system for directly stirring and homogenizing the batch and the products generated in the process stages; the reaction vessel must comprise at least:

i. an entry for the feedstock;
ii. a top output adapted to a cooling system for optionally establishing the reflux conditions of volatile products generated or for removal of volatile gases and products; and
iii. an output in the bottom of the reaction vessel for removing the residual products generated.

The following examples illustrate the process for obtaining pitches with distinct properties in tests conducted on a prototype unit with a capacity of up to 75 kg comprising: a reactor configured for the process, a collection vessel for the condensate generated and collection vessel for the residue—tar oil.

Two decanted oil feedstocks were used, OD1 and OD2, with an aromatic content of 64.4% m/m and 65.5% m/m, respectively, processed at atmospheric pressure according to the following variables:

T1—Initial temperature of the first reflux, ° C.;

T2—Initial temperature of the second reflux, ° C., $t_1$—time of the first heating in reflux conditions, time;

$t_2$—time of the second heating in reflux conditions, time;

The yields obtained are expressed as a % by weight in relation to the batch:

$Yc_1$—condensate removed in the first stage of distillation;

Yp—output of pitch;

Yc—total yield in condensate.

The pitches were analyzed in the laboratory, according to the following properties:

SP—softening point of the pitch, ASTM D-3104 method;

TI—toluene insolubles in the pitch, ASTM D-4312 method;

QI—quinoline insolubles in the pitch, ASTM D-2318 method.

EXAMPLE 1

The data presented in Table 1 correspond to four tests (A, B, C and D) performed with approximately 65 kg of the OD1 feedstock in the prototype unit at atmospheric pressure. The results of the analyses of the residue are related to the process conditions, and the graph of FIG. 2 presents the temperature (° C.) versus time (h) curves of the process over 8 hours (for of each test).

In a first test A, taken as a reference, the feedstock was preheated and introduced into the reaction vessel, under continuous and uniform heating up to a maximum temperature of 442° C., the temperature being maintained above 430° C. over the last 3 hours of distillation, for a total of 8 hours of heat treatment. In a single distillation stage, the volatile products generated were continuously removed by condensation at the top outlet of the reactor, recovering a condensate mass (Yc=53.7% by weight in relation to the feedstock). The residual products were recovered at the bottom of the reactor and removed to a collector vessel, under refrigeration, and the final residue (Yp=33.7% by weight in relation to the feedstock) called pitch was analyzed.

In a second test B, the feedstock was subjected to the following stages in the reactor: (a) preheating up to 300° C.; (b) continuous and uniform heating of the feedstock under reflux conditions for 17 hours at a temperature of 350° C. in a homogeneous liquid phase, generating residual products in the reaction conditions and gaseous products that were eliminated; (c) distillation of the residual products to a temperature of 414° C., with the generation of: residual products, gaseous products that were eliminated, and volatile products that were removed by condensation until generating 15% by weight of condensate ($Yc_1$) in relation to the feedstock; (d) heating in reflux conditions for 3 hours; (e) distillation with heating up to the maximum temperature of 442° C., the volatile products generated (Yc) by condensation being removed after exiting the top, recovering an oil residue (Yp=38.4% by weight in relation to the feedstock) at the bottom of the vessel reaction, which was removed into a collection vessel under refrigeration and analyzed in the laboratory.

Figure 2:
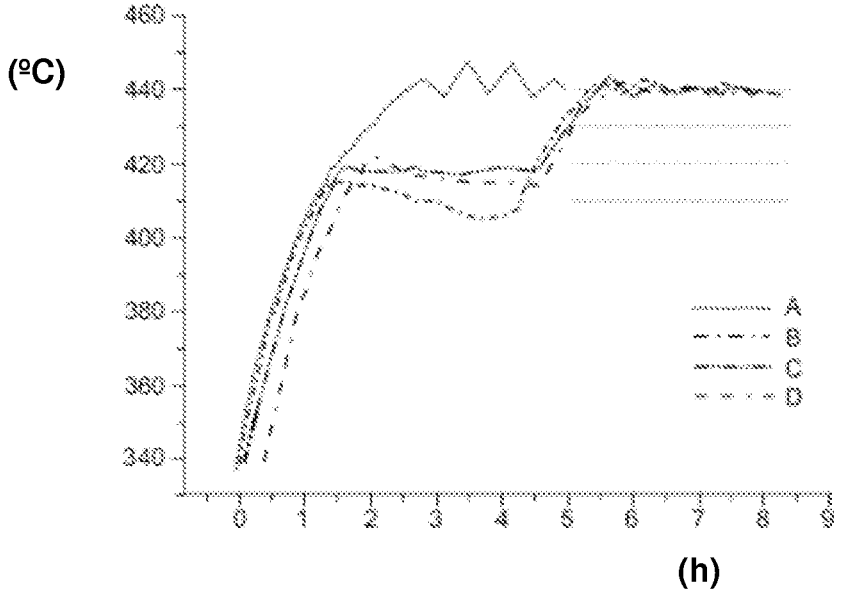
FIG. 2 shows the temperature (° C.) versus time (h) curves, for four tests (A, B, C and D) illustrating the production of pitches from a decanted oil (OD1).

In FIG. 2 one notes an immediate temperature drop at the start of the second reflux (d) controlled by the cooling rate of the volatile products generated that return to the reaction, influencing the formation of insolubles and the softening point of the end product.

In a third test C, the feedstock was subjected to the following stages: (a) pre-heating at a temperature of 300° C.; (b) continuous and uniform heating of the feedstock, maintaining it in reflux for 18 hours at 341° C.; (c) distillation up to the temperature of 419° C. with removal of the volatile products generated by condensation until generating ($Yc_1$) 25% by weight of condensate in relation to the feedstock; (d) heating in reflux conditions for 3 hours; (e) distillation with heating up to the maximum temperature of 443° C., with total removal of volatile products (Yc) by condensation after exiting from the top, and recovering an oil residue (Yp=40.4% by weight in relation to the feedstock) at the bottom of the reaction vessel, which was removed to a refrigerated collection vessel and analyzed in the laboratory.

FIG. 2 shows the second reflux (d) with a less sharp temperature drop compared with the drop seen in test B.

In a fourth test D, the feedstock was subjected to the following stages: (a) pre-heating to a temperature of 300° C.; (b) continuous and uniform heating of the feedstock, maintaining it in reflux for 20 hours at a temperature of 344° C.; (c) distillation up to the temperature of 422° C. with removal of the volatile products generated by condensation after exiting the top of the reaction vessel, until generating ($Yc_1$) 34% by weight of condensate in relation to the feedstock; (d) heating in reflux conditions for 2 hours; (e) distillation with heating up to the maximum temperature of 442° C., with total removal of volatile products (Yc) generated after exiting from the top, and recovering an oil residue (Yp=34.6% by weight in relation to the feedstock) at the bottom of the reaction vessel, which was removed to a refrigerated collection vessel and analyzed in the laboratory.

TABLE 1

| | Process Conditions | | | | | | | Analysis of the Pitch | | |
|---|---|---|---|---|---|---|---|---|---|---|
| Test | $Yc_1$ | t1 | T1 | t2 | T2 | Yp | Yc | SP | TI | QI |
| A | — | — | — | — | — | 33.7 | 53.7 | 109.7 | 23.1 | 4.7 |
| B | 15 | 17 | 350 | 3 | 414 | 38.4 | 52.6 | 110.1 | 26.5 | 5.4 |
| C | 25 | 18 | 341 | 3 | 419 | 40.4 | 51.1 | 112.3 | 26.2 | 5.9 |
| D | 34 | 20 | 344 | 2 | 422 | 34.6 | 51.1 | 115.8 | 29.3 | 9.2 |

From the data of Table 1, test D with a higher mass of condensate ($Yc_1$) removed in the first stage of distillation, it exhibited a higher result for IT and little increase in SP with respect to test A, it being a predominantly isotropic pitch with binder pitch properties. In test D, in the stage of a second reflux there was a slow drop and higher temperature during the reflux, reaching a lower temperature when compared to the temperature drop in test B; this results in a smaller temperature rise more of the SP and lower insolubles under milder process conditions.

Under reflex, the dilution effect due to the volatile products and the lowering of the reaction temperature prevent the poly-condensation reactions of aromatic molecules in larger molecules that contribute to increasing the softening point of the residue (pitch).

EXAMPLE 2

Figure 3:
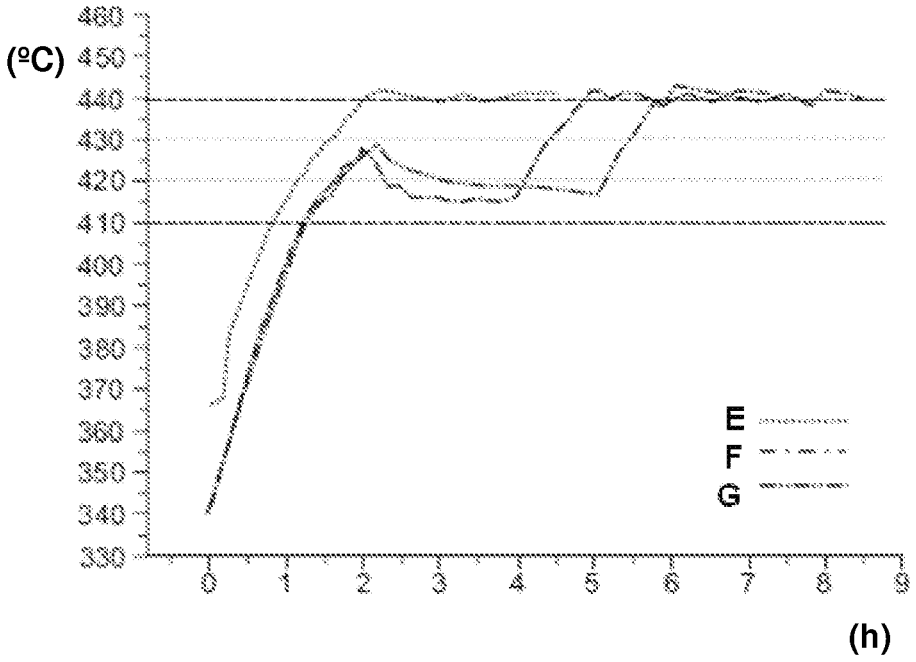
FIG. 3 shows the temperature (° C.) versus time (h) curves, for three tests (E, F, and G) illustrating the production of pitches from a decanted oil (OD2).

The data presented in Table 2 correspond to 3 tests (E, F, and G) performed with approximately 65 kg of the OD2 as feedstock in the prototype unit, at atmospheric pressure. The results of the analyses of the final residue obtained are related to the process conditions, and the graph of FIG. 3 presents the temperature (° C.) versus time (h) curves in eight hours of reaction.

In a first test E, taken as a reference for the condition of a sole reflux stage, the feedstock was introduced into the reaction vessel and subjected to the following stages: (a) preheating to a temperature of 300° C.; (b) continuous and uniform heating of the feedstock, maintaining it in reflux for 16 hours at 366° C.; (c) distillation to a maximum temperature of 440° C., being maintained above 430° C. in the final 3 hours, with complete separation of the volatile products by condensation following the outflow from the top of the reaction vessel, and recovering: a condensate (Yc=50.6% by weight relative to the mass of the feedstock) and an oil residue (Yp) at the bottom of the reaction vessel that was removed into a collection vessel under refrigeration and analyzed in the laboratory.

In a second test F, the feedstock was introduced into the reaction vessel and subjected to the following stages: (a) pre-heating at a temperature of 300° C.; (b) continuous and uniform heating of the feedstock, maintaining it in reflux for 41 hours at a temperature of 347° C.; (c) distillation up to the temperature of 427° C. with removal of the volatile products generated, by condensation following outflow from the top of the reaction vessel, recovering: a condensate volume ($Yc_1$=30% by weight in relation to the mass of the feedstock); (d) heating in reflux condition for two hours; (e) distillation with heating up to the maximum temperature of 441° C., with total removal of volatile products generated, by condensation after outflow from the top of the reaction vessel, and recovering: a condensate (Yc) and an oil residue at the bottom of the reaction vessel (Yp=44.8% by weight in relation to the feedstock), which was removed to a refrigerated collection vessel and analyzed in the laboratory.

In a second test G, the feedstock was introduced into the reaction vessel and subjected to the following stages: (a) pre-heating at a temperature of 300° C.; (b) continuous and uniform heating of the feedstock, maintaining it in reflux for 21 hours at a temperature of 354° C.; (c) distillation up to the temperature of 422° C. with removal of the volatile products generated by condensation following outflow from the top of the reaction vessel recovering a condensate ($Yc_1$)=30%); (d) heating in a reflux condition for three hours; (e) distillation with heating up to the temperature of 443° C., with total removal of volatile products generated by condensation following outflow from the top of the reaction vessel, and recovering: a condensate (Yc) and a residue (Yp=45.3%) at the bottom of the reaction vessel, which was removed to a refrigerated collection vessel and analyzed in the laboratory.

TABLE 2

| | Process Conditions | | | | | | | Analysis of the Tar | | |
|---|---|---|---|---|---|---|---|---|---|---|
| Test | $Yc_1$ | t1 | T1 | t2 | T2 | Yp | Yc | SP | TI | QI |
| E | — | 16 | 366 | — | — | 41.4 | 50.6 | 122.3 | 27.5 | 5.3 |
| F | 30 | 41 | 347 | 2 | 427 | 44.8 | 47.0 | 112.8 | 27.9 | 7.8 |
| G | 30 | 21 | 354 | 3 | 422 | 45.3 | 42.5 | 121.6 | 30.0 | 8.0 |

In F test, it was found that the longer time of a first reflux and the milder temperature condition and shorter time in the second and heating under reflux conditions contribute to further reducing the SP when compared to test E, and a slight increase in toluene insolubles was also observed. The result for insolubles in test G shows the production of a binder pitch. The best result in test G was accompanied by a higher content of insolubles and a small decrease in softening point when compared to reference test E.

Comparing the reference tests (E and A), it is evident that the heating stage in conditions of a first reflux contributes to increasing the pitch yield, noting that upon heating in reflux conditions the paraffin fractions decompose almost completely and promote the dealkylation reactions of the alkyl aromatics and light aromatic condensation.

The results presented in Tables 1 and 2 illustrate the highest values of quinoline insolubles obtained when the second reflux stage was implemented following the removal of more than 30% of the condensate ($Yc_1$) in tests D, F and G.

Based on the test results, it may be concluded that the reflux of volatile compounds following a distillation stage, repeatedly, provides flexibility to the process, as it makes it possible to obtain pitches with distinct properties, ensuring a higher yield when compared to the conventional distillation process, and can produce pitches with improved properties with respect to the insolubles without significantly increasing the softening point.

Therefore, the process, with heating under reflux conditions followed by distillation with removal of volatile products generated and sequential repetition of the two stages, provides flexibility and selectivity to the reactions, thus obtaining pitches with distinct characteristics for various industrial applications. And, having been described in its preferred embodiment, variations and modifications are also possible without departing from the scope of the process and the configured reactor, according to the below claims.

The invention claimed is:

1. Process for the production of pitch, comprising the following steps at atmospheric pressure:

a) preheating of a feedstock up to a initial reaction temperature;

b) continuous and uniform heating, in conditions of a first reflux at an initial reaction temperature of between 300° C. and 370° C., for a time sufficient to promote reactions between hydrocarbon components, in a homogeneous liquid phase, generating: gaseous products that are eliminated and residual products in the reaction conditions;

c) distillation of the residual products generated in stage b) up to a maximum temperature between 380° C. and 450° C., generating: residual products, gaseous products that are eliminated, and volatile products that are removed by condensation in the proportion between 5% and 60% by weight in relation to the feedstock;

d) continuous and uniform heating of the residual products generated in the preceding distillation stage in reflux conditions at a temperature between 5° C. and 50° C. below the maximum temperature of the distillation, for a time between 1 and 60 times less than that of the heating in stage b), to promote reactions, generating: gaseous products that are removed and residual products in the reaction conditions;

e) distillation of the residual products generated in stage d) up to a maximum temperature between 390° C. and 485° C., generating: gaseous products that are eliminated, volatile products that are removed by condensation, and residual products;

f) sequential repetition of the two preceding stages, d) and e), to obtain residual products comprising pitch with a yield in relation to the feedstock between 30% and 60% by weight; and g) recovery of the pitch under refrigeration to specify a predominantly isotropic end product; wherein steps a)-g) occur at atmospheric pressure.

2. Process according to claim 1, wherein the heating in a first reflux is done for a time between 1 and 120 hours.

3. Process according to claim 2, wherein the heating is done for a time between 1 and 90 hours.

4. Process according to claim 2, wherein the heating is done for a time between 1 and 60 hours.

5. Process according to claim 1, wherein the volatile products are removed in stage c) in the proportion between 5% and 40% by weight.

6. Process according to claim 1, wherein the temperature of stage d) is between 5° C. and 30° C. below the maximum distillation temperature.

7. Process according to claim 1, wherein the heating time of stage d) is between 1 and 20 times less than that of stage b).

8. Process according to claim 1, wherein stages d) and e) are repeated between 1 and 10 times.

9. Process according to claim 8, wherein stages d) and e) are repeated between 1 and 5 times.

10. Process according to claim 1, wherein the feedstock is a decanted oil which comes from a catalytic cracking process and contains between 30% and 80% by weight of aromatic hydrocarbons.

* * * * *